US007714493B2

(12) United States Patent
Du et al.

(10) Patent No.: US 7,714,493 B2
(45) Date of Patent: May 11, 2010

(54) FIELD EMISSION DEVICE AND FIELD EMISSION DISPLAY EMPLOYING THE SAME

(75) Inventors: Bing-chu Du, Beijing (CN); Jie Tang, Beijing (CN); Cai-lin Guo, Beijing (CN); Liang Liu, Beijing (CN); Zhao-fu Hu, Beijing (CN); Pi-jin Chen, Beijing (CN); Shou-shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 834 days.

(21) Appl. No.: 11/438,022

(22) Filed: May 19, 2006

(65) Prior Publication Data

US 2007/0052338 A1 Mar. 8, 2007

(30) Foreign Application Priority Data

Jun. 24, 2005 (CN) ..... 2005 1 0035536

(51) Int. Cl.
*H01J 9/02* (2006.01)
*H01J 1/02* (2006.01)

(52) U.S. Cl. ..... 313/310; 313/495

(58) Field of Classification Search ..... 313/495–497, 313/294–304, 306, 308, 310; 257/167, 10–11
See application file for complete search history.

(56) References Cited

U.S. PATENT DOCUMENTS 5,982,091 A * 11/1999 Konishi ..... 313/495
6,437,503 B1 8/2002 Konuma
6,445,124 B1 9/2002 Asai et al.
6,486,609 B1 11/2002 Shiratori et al.
6,690,116 B2 2/2004 Song et al.
6,717,340 B2 * 4/2004 Nishimura ..... 313/310
6,741,019 B1 * 5/2004 Filas et al. ..... 313/355
7,161,289 B2 1/2007 Lee et al.
2002/0109460 A1 * 8/2002 Hasegawa et al. ..... 313/555
2003/0230968 A1 * 12/2003 Lee et al. ..... 313/495

(Continued)

FOREIGN PATENT DOCUMENTS

JP 07-262908 A 10/1995

(Continued)

*Primary Examiner*—Nimeshkumar D. Patel
*Assistant Examiner*—Peter R Haderlein
(74) *Attorney, Agent, or Firm*—Clifford O. Chi

(57) ABSTRACT

A field emission device (6), in accordance with a preferred embodiment, includes a cathode electrode (61), a gate electrode (64), a separator (62), and a number of emissive units (63) composed of an emissive material. The separator includes an insulating portion (621) and a number of conductive portions (622). The insulating portion of the separator is configured between the cathode electrode and the gate electrode for insulating the cathode electrode from the gate electrode. The emissive units are configured on the separator at positions proximate to two sides of the gate electrode. The emissive units are in connection with the cathode electrode via the conductive portions respectively. The emissive units are distributed on the separator adjacent to two sides of the gate electrode, which promotes an ability of emitting electrons from the emissive material and the emitted electrons to be guided by the gate electrode toward a smaller spot they bombard.

3 Claims, 3 Drawing Sheets

U.S. PATENT DOCUMENTS

| | | | | |
|---|---|---|---|---|
| 2004/0164666 | A1* | 8/2004 | Yaguchi et al. | 313/495 |
| 2005/0093424 | A1* | 5/2005 | Moon | 313/495 |
| 2005/0116610 | A1* | 6/2005 | Jung et al. | 313/495 |

FOREIGN PATENT DOCUMENTS

| | | | |
|---|---|---|---|
| JP | 2004186129 | | 7/2004 |
| JP | 2005044721 | A * | 2/2005 |
| TW | 5295062 | | 4/2003 |
| TW | 564453 | | 12/2003 |
| TW | 1220263 | | 8/2004 |

* cited by examiner

FIELD EMISSION DEVICE AND FIELD EMISSION DISPLAY EMPLOYING THE SAME

BACKGROUND OF THE INVENTION

1. Field of the Invention

The present invention relates to a field emission device for emitting electrons from an emissive material and, more particularly, to a field emission device having an improved electron emission performance, which can be used for high-resolution field emission display.

2. Discussion of the Related Art

Field emission displays (FEDs) are new, rapidly developing flat panel display technologies. Compared to conventional technologies, e.g., cathode-ray tube (CRT) and liquid crystal display (LCD) technologies, FEDs are superior in having a wider viewing angle, low energy consumption, a smaller size, and a higher quality display. In particular, carbon nanotube-based FEDs (CNTFEDs) have attracted much attention in recent years.

Carbon nanotube-based FEDs employ carbon nanotubes (CNTs) as electron emitters. Carbon nanotubes are very small tube-shaped structures essentially composed of a graphite material. Carbon nanotubes produced by arc discharge between graphite rods were first discovered and reported in an article by Sumio Iijima, entitled "Helical Microtubules of Graphitic Carbon" (Nature, Vol. 354, Nov. 7, 1991, pp. 56-58). Carbon nanotubes can have an extremely high electrical conductivity, very small diameters (much less than 100 nanometers), large aspect ratios (i.e. length/diameter ratios) (potentially greater than 1000), and a tip-surface area near the theoretical limit (the smaller the tip-surface area, the more concentrated the electric field, and the greater the field enhancement factor). Thus, carbon nanotubes can transmit an extremely high electrical current and have a very low turn-on electric field (approximately 2 volts/micron) for emitting electrons. In summary, carbon nanotubes are one of the most favorable candidates for electrons emitters in electron emission devices and can play an important role in field emission display applications.

Generally, FEDs can be roughly classified into diode type structures and triode type structures. Diode type structures have only two electrodes, a cathode electrode and an anode electrode. Diode type structures can be used in characters display, but are unsatisfactory for applications requiring high-resolution displays, such as picture and graph display, because of their relatively non-uniform electron emissions and difficulty in controlling their electron emission. Triode type structures were developed from diode type structures by adding a gate electrode for controlling electron emission. Triode type structures can emit electrons at relatively lower voltages.

FIG. 1 is a schematic view illustrating a conventional triode type field emission device 4, which includes a cathode electrode 40, an anode electrode 45 spaced from the cathode electrode 40 and a gate electrode 43 disposed between the cathode and the anode electrodes 40, 45. A barrier 44 is disposed between the cathode electrode 40 and the anode electrode 45 thereby separating the two electrodes 40, 45. Generally, an insulating layer 42 is deposited on the cathode electrode 40 for supporting the gate electrode 43, i.e., the gate electrode 43 is formed on a top surface of the insulating layer 42. The insulating layer 42 defines a cylindrical hole (not labeled) therein for exposing the cathode electrode 40. An emissive material 41, such as carbon nanotube, is disposed in the cylindrical hole on the exposed cathode electrode 40.

Furthermore, a phosphor material 46 is formed on a surface of the anode electrode 45 facing to the cathode electrode 40. In the illustrated structure, the phosphor material 46 represents a picture element for displaying. A picture element means a minimum unit of an image displayed by the FED (i.e., a pixel). In a typical color FED, the color picture is obtained by a display system using three optical primary colors, i.e., R (red), G (green), and B (blue).

In use, different voltages are applied to the cathode electrode 40, the anode electrode 45 and the gate electrode 43. Electrons 410 are emitted from the emissive material 41, and then travel through the cylindrical hole, finally reach to the anode electrode 45 and the phosphor material 46. Therefore, the phosphor material 46 is activated and a visible light is produced.

The above field emission device, however, has a low resolution. Because electrons extracted from the emissive material 41 are diverged away from a central axis of the phosphor material 46 when they travel to the anode electrode 45, thus, a spot that electrons bombard on the phosphor material 46 is enlarged. In addition, some of the diverged electrons are diverged at a large angle and bombard on a neighboring picture element (not shown), therefore an error display is occurred. Furthermore, a high voltage for extracting electrons from the emissive material is needed because of a large distance between the emissive material and the gate electrode.

Therefore, what is needed is a field emission device having a high resolution, lower voltage for emitting electrons, and a high emission efficiency.

SUMMARY

Accordingly, a field emission device, in accordance with a preferred embodiment, includes a cathode electrode, a gate electrode, a separator, and a number of emissive units composed of an emissive material. The separator includes an insulating portion and a number of conductive portions. The insulating portion of the separator is configured between the cathode electrode and the gate electrode for insulating the cathode electrode from the gate electrode. The emissive units are configured on the separator at positions proximate to two sides of the gate electrode. The emissive units are in connection with the cathode electrode via the conductive portions respectively. That the emissive units are distributed on the separator adjacent to two sides of the gate electrode promotes the ability of emitting electrons from the emissive material and the emitted electrons to be guided by the gate electrode toward a smaller spot they bombard.

Other objects, advantages and novel features of the present invention will become more apparent from the following detailed description when taken in conjunction with the accompanying drawings.

BRIEF DESCRIPTION OF THE DRAWINGS

Many aspects of the present field emission device can be better understood with reference to the following drawings. The components in the drawings are not necessarily to scale, the emphasis instead being placed upon clearly illustrating the principles of the present device. Moreover, in the drawings, like reference numerals designate corresponding parts throughout the several views.

The exemplifications set out herein illustrate at least one preferred embodiment of the present field emission device, in one form, and such exemplifications are not to be construed as limiting the scope of the invention in any manner.

DETAILED DESCRIPTION OF PREFERRED EMBODIMENTS

Reference will now be made to the drawings to describe preferred embodiments of the present field emission device, in detail.

Figure 1:
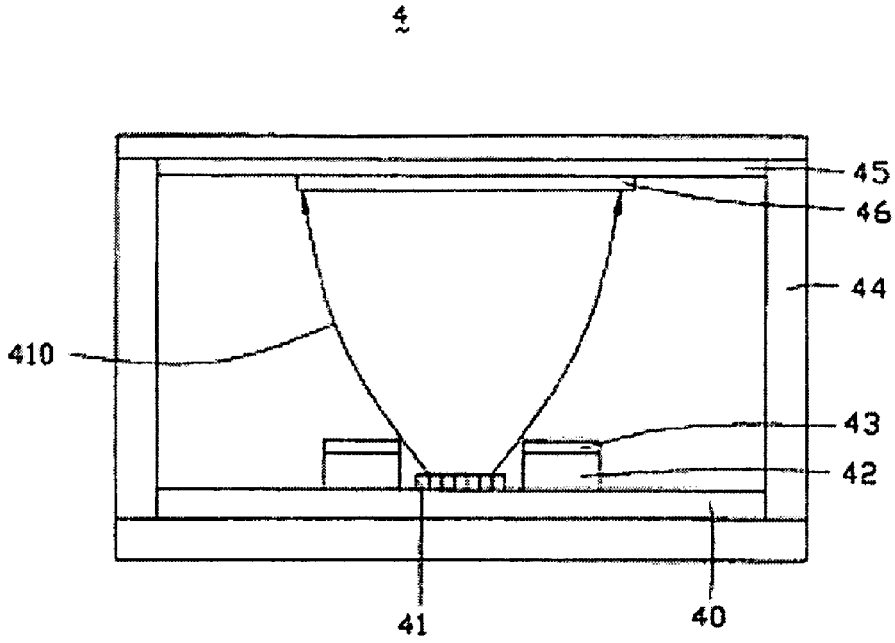
FIG. 1 is a schematic, cross-sectional view of a conventional field emission device.
Figure 2:
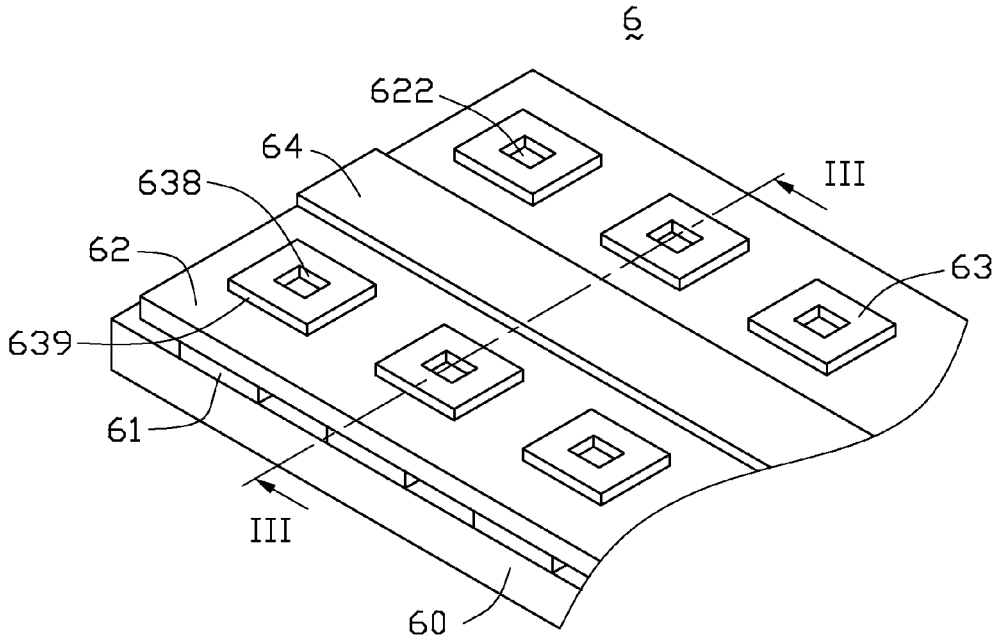
FIG. 2 is a schematic, isometric view of a field emission device, according to a first preferred embodiment.
Figure 3:
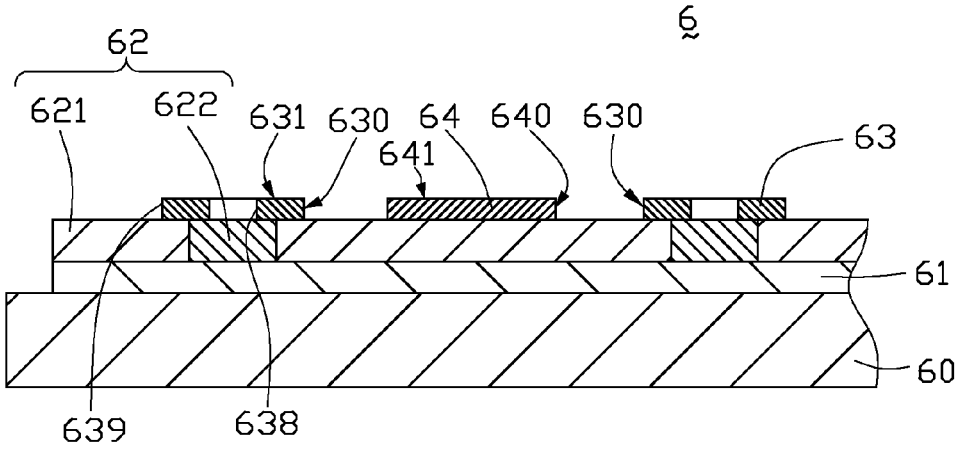
FIG. 3 is an partial cross-sectional view along line III-III of FIG. 2.

Referring to FIGS. 2 and 3, an exemplarily field emission device 6 in accordance with a first preferred embodiment is shown. The field emission device 6 includes a bottom substrate 60, a number of cathode electrodes 61 disposed on the bottom substrate 60, a separator 62 disposed on the cathode electrodes 61, a number of gate electrodes 64 (only one is shown in FIG. 2 for illustration) disposed on the separator 62, and a number of emissive units 63 distributed on the separator 62. The emissive units 63 are respectively distributed proximate two sides of a gate electrode 64 associated therewith.

Generally, the bottom substrate 60 includes a sheet of insulative plate composed of an insulation material, such as glass, silicon, ceramic, etc. The cathode electrodes 61 are disposed parallel to each other along a first direction on the bottom substrate 60, and can be made of a conductive material, such as indium-tin-oxide (ITO) and metallic material. Each of the cathode electrodes 61 can be made into elongated stripe-shaped thin film or layer and is spaced from each other. The separator 62 is configured on the cathode electrode 61 for holding the gate electrodes 64 and the emissive units 63. The separator 62 is composed of an insulation portion 621 and a number of conductive portions 622 distributed in the insulation portion 621. Each of the conductive portions 622 is respectively located at a position corresponding to an emissive unit 63 and is configured for electrically connecting the respective emissive unit 63 to a corresponding cathode electrode 61. The insulation portion 621, i.e., the rest part of the separator 62 other than the conductive portions 622, is disposed between the cathode electrodes 61 and the gate electrodes 64, thus the former is insulated from the latter. Further, referring to FIG. 3, each of the emissive units 63 has an inner periphery 638 with a first diameter and an outer periphery 639 with a second diameter, and each of the conductive portions 622 has a third diameter larger than the first diameter but smaller than the second diameter. Each of the conductive portions 622 is positioned under and within an area defined by the outer periphery 639 of one corresponding emissive unit 63. In the present embodiment, the conductive portions 622 can be made, for example, by following method: manufacturing an insulative prototype separator, etching a number of through holes in the prototype separator at predetermined positions; filling a conductive material, such as copper, silver and other metals having a good conductivity, into the through holes, thus a separator having a number of conductive portions embedded therein is obtained.

The gate electrodes 64 are disposed parallel to each other and are placed on the separator 62 along a second direction perpendicular to the first direction, thus the gate electrodes 64 are perpendicular to the cathode electrodes 61. The gate electrodes 64 can be made of a conductive material, preferably a metal having good conductivity Each of the gate electrodes 64 can be made into longitudinal strip-shaped thin film or layer and is spaced from each other. In the present embodiment, each of the gate electrodes 64 defines a top surface 641, a bottom surface (not labeled) opposite to the top surface 641, and two lateral surfaces 640 between the top surface 641 and the bottom surface.

The emissive units 63 are made of an electron emissive material, such as carbon nanotubes, carbon fibers and sharp-tipped elements comprised of at least one of graphite carbon, diamond carbon, silicon, and an emissive conductive metal. Each of the emissive units 63 can be structured into a desired form, such as a rectangular shape, as shown in FIG. 2. In the present embodiment, each of the emissive units 63 defines a top surface 631, a bottom surface opposite to the top surface 631, and a number of lateral surfaces 630 between the top surface 631 and the bottom surface. Advantageously, each of the emissive unites 63 is arranged adjacent the gate electrode 64, such that at least one of the lateral surfaces 630 of the emissive unit 63 is proximate and facing to one of the lateral surface 640 of the gate electrode 64. As such, a distance between the lateral surface 640 of the gate electrode 64 and the proximate lateral surface 630 of the emissive unit 63 can be minimized without short-circuiting therebetween. Preferably, such distance can be, for example, about several microns or less. Therefore, a minimum electric field between the gate electrode and emissive units required for extracting electrons from the emissive units can be lowered, i.e., a threshold voltage applied for the gate electrode can be lowered.

Advantageously, the emissive units 63 associated with a corresponding gate electrode 64 are regularly arranged in two columns aligned the second direction. Each emissive unit 63 has at least a portion of the lateral surface 630 directly facing the proximate lateral surface 640 of the corresponding gate electrode 64, i.e., at least a portion of a projection of the lateral surface 630 can be projected onto the proximate lateral surface 640 of the corresponding gate electrode 64. In the present embodiment, the entire lateral surface 630 of the emissive unit 63 is directly facing the proximate lateral surface 640 of the gate electrode 64. The top surface 631 and the bottom surface of each emissive unit 63 are substantially coplanar with the top surface 641 and the bottom surface of the gate electrodes 64, respectively.

Figure 4:
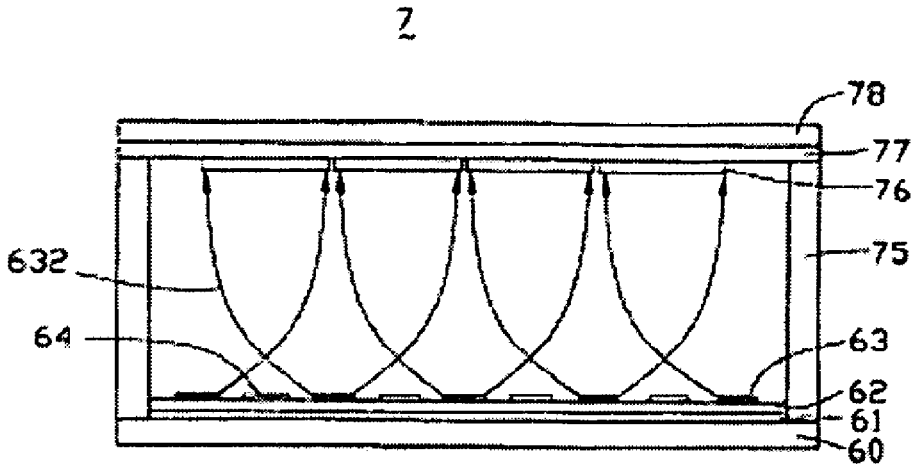
FIG. 4 is a schematic, cross-sectional view of a field emission display, according to a second embodiment.

Referring to FIG. 4, a field emission display device 7 employing the above field emission device 6, according to another embodiment, is shown. In addition to the field emission device 6, the field emission display device 7 further includes a top plate 78 opposite to the bottom substrate 60, an anode electrode 77 formed on a surface of the top plate 78, a phosphor layer 76 composed of a number of picture elements 761 formed on the anode electrode 77, and a number of spacers 75 configured for separating the top plate 78 from the bottom substrate 60. Generally, the anode electrode may be made of an ITO conductive thin film. Each of the picture elements 761 of the phosphor layer 76 corresponds to a gate electrode 64 and two emissive units 63 proximate the gate electrode 64. Preferably, the gate electrode 64 is directly facing a central area of the picture element 761 of the phosphor layer 76. As such, the two emissive units 63 associated with the picture element 761 are configured for facing two side areas of the picture element 761 and offsetting from the central area of the picture element 761.

In operation, electrons 632 can be extracted from the emissive units 63 by a strong electric field generated by the corresponding gate electrode 64 and focused on the central area of the picture element 761 or a vicinity thereof. Thus, a size of spot that electrons bombarded on the picture element is lowered and a resolution of displaying is improved. Specifically, electrons 632 emitted from the emissive unit 63 located at a left side of the gate electrode 64 are attracted towards the central area of the picture element 761 or a right side thereof during their travel to the anode electrode 77. Similarly, electrons 632 emitted from the emissive unit 63 located at a right side of the gate electrode 64 are attracted towards the central area of the picture element 761 or a left side thereof during their travel to the anode electrode 77.

Figure 5:
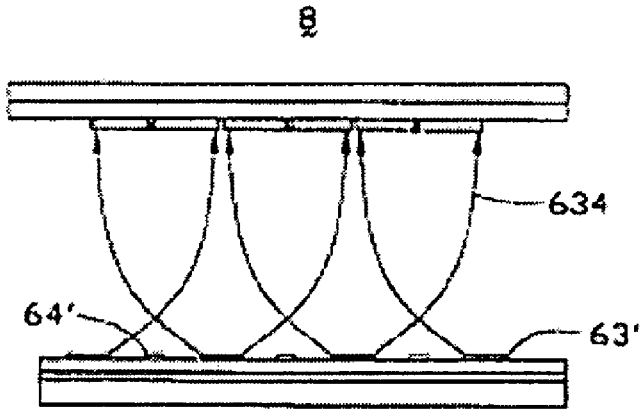
FIG. 5 is a schematic, cross-sectional view of a field emission display, according to a third embodiment.

Referring to FIG. 5, a field emission display device 8 employing the field emission device, according to a third embodiment is shown. For purpose of simplifying description, only one pixel structure of the display device is illustrated. The pixel structure of the display device is composed of three primary color areas for emitting three primary colors, i.e., red (R), green (G) and blue (B). Each of the primary color areas corresponds to a gate electrode 64' and two emissive units 63' proximate two sides of the gate electrode 64'. Preferably, the gate electrode 64' is directly facing a central area of a primary color area. As such, the two emissive units 63' associated with the primary color area are configured for facing two sides of the central area of the primary color area. Therefore, electron emission for bombarding each of the primary color area can be precisely controlled, and a higher resolution displaying is realized.

It is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A field emission display device comprising:

a plurality of spaced cathode electrodes;

a plurality of gate electrodes, each of the gate electrodes having a first bottom surface;

a separator disposed between the cathode electrodes and the gate electrodes for insulating the cathode electrodes and the gate electrodes, a plurality of conductive portions embedded in the separator;

a plurality of emissive units disposed at and spacedly closing opposite sides of each of the gate electrodes, the emissive units being arranged on the separator and electrically connecting with the cathode electrodes via the conductive portions respectively, each of the emissive units having a second bottom surface;

an anode electrode spaced from the cathode electrodes; and a phosphor layer attached to the anode electrode and comprising a plurality of spaced pixel structures, each pixel structure comprising a plurality of picture elements each corresponding to one of the gate electrodes and the emissive units disposed at and spacedly closing opposite sides of the gate electrode;

wherein the second bottom surface of each of the emissive units is substantially coplanar with the first bottom surface of the corresponding gate electrode;

wherein each of the emissive units which are located at one common side of one of the gate electrodes and electrically connect with the cathode electrodes, directly aligns with a corresponding emissive unit located at opposite side to the common side;

wherein each of the emissive units has an inner periphery with a first diameter and an outer periphery with a second diameter, and each of the conductive portions has a third diameter larger than the first diameter but smaller than the second diameter, and each of the conductive portions is positioned under and within an area defined by the outer periphery of one corresponding emissive unit.

2. The field emission display device as claimed in claim 1, wherein said one of the gate electrodes faces a central area of the corresponding picture element and the emissive units disposed at and spacedly closing opposite sides of the gate electrode faces opposite side areas of the corresponding picture element.

3. The field emission display device as claimed in claim 1, wherein each of the emissive units located between two adjacent gate electrodes is capable of emitting electrons to two picture elements corresponding to the two adjacent gate electrodes.

* * * * *